United States Patent [19]

Tateoka et al.

[11] Patent Number: 4,881,618

[45] Date of Patent: Nov. 21, 1989

[54] ACOUSTIC LENS FOR USE IN ACOUSTIC MICROSCOPE

[75] Inventors: Hitoshi Tateoka, Ohme; Fumio Uchino, Hachioji, both of Japan

[73] Assignee: Olympus Optical Co., Ltd., Japan

[21] Appl. No.: 56,685

[22] Filed: Jun. 2, 1987

[30] Foreign Application Priority Data

Jun. 6, 1986 [JP] Japan ..... 61-131511

[51] Int. Cl.[4] ..... G10K 11/06

[52] U.S. Cl. ..... 181/176; 181/175

[58] Field of Search ..... 181/176, 175

[56] References Cited

U.S. PATENT DOCUMENTS

| | | | |
|---|---|---|---|
| 3,295,629 | 1/1967 | Papadakis | 181/176 X |
| 3,687,219 | 8/1972 | Langlois | 181/176 |
| 3,825,887 | 7/1974 | Murry | 181/176 X |
| 3,866,711 | 2/1975 | Folds | 181/176 |
| 4,651,850 | 3/1987 | Mastsuo | 181/176 |

FOREIGN PATENT DOCUMENTS

| | | |
|---|---|---|
| 0019210 | 2/1985 | European Pat. Off. . |
| 5950937 | 10/1980 | Japan . |
| 57-120250 | 7/1982 | Japan . |
| 58-44343 | 3/1983 | Japan . |
| 60-149963 | 8/1985 | Japan . |

OTHER PUBLICATIONS

"Acoustic Microscopy by Mechanical Scanning" by R. A. Lemons, May, 1975 M. L. Report No. 2456.

"Characteristic Material Signatures by Acoustic Microscope" by R. D. Weglein and R. G. Wilson in "Electronics Letters", vol. 14, No. 12, Jun. 6, 1978.

"An Angular-Spectrum Approach to Contrast in Reflection Acoustic Microscopy" by A. Atalar in "Journal of Applied Physics", vol. 49, No. 10. pp. 5130-5139.

"Modulation Transfer Function for the Acoustic Microscope" by A. Atalar in "Electronics Letters", vol. 15, No. 11, May 24, 1979.

"Ray Interpretation of the Material Signature in the Acoustic Microscope" by W. Parmon and H. L. Berton, in "Electronics Letters", vol. 15, No. 21, Oct. 11, 1979.

*Primary Examiner*—B. R. Fuller

*Attorney, Agent, or Firm*—Arnold, White & Durkee

[57] ABSTRACT

An acoustic lens for use in an acoustic microscope including a solid state medium for propagating an acoustic wave having a wavelength λ and having opposed end surfaces, an electric-acoustic transducer applied on one end surface of the solid state medium and having a radius a, and a spherical lens portion formed in the other end surface of the solid state medium and having an aperture of a radius w. The length l and the aperture radius w are normalized by the transducer radius a such that $Z=l\lambda/a^2$ and $W=w/a$. Values of Z and W are selected from such a region in a first quadrant of the Z-W coordinate system that desired power and/or phase are obtained. The region neighboring the point $Z=1$ and $W=1$ is excluded.

7 Claims, 18 Drawing Sheets

Amplitude Property

Phase Property

Vmax
SI=60°
W=-5Z+3.5
W=-5Z+3
W=Z
W=-4Z+10.5
W=-1/9Z+1
-26dB
-24dB
-22dB
-20dB
-18dB
-16dB
-14dB
-12dB
-11dB
-10dB
-9dB
-8dB
-7dB
-6dB
-5dB
-4dB
-3dB
-2dB
-1dB
-0dB
-8dB
-1dB
-8dB
-1dB
-10dB
-12dB
W
Z
0
0.5
1.0
1.5
2.0
2.5
3.0
3.5
4.0
5.0

ACOUSTIC LENS FOR USE IN ACOUSTIC MICROSCOPE

BACKGROUND OF THE INVENTION

1. Field of the Invention

This invention relates to an acoustic lens for use in an acoustic microscope comprising an ultrasonic wave propagating solid state medium having opposite end surfaces, an electric-acoustic piezoelectric transducer applied on one end surface of said solid state medium, and a lens portion formed in the other end surface of said solid state medium.

2. Description of the Prior Art

Measurements utilizing acoustic energy have been applied in various applications such as sonar, defect detector and fish finder technologies. In medical applications, ultrasonic diagnosing apparatus has been widely used. Recently there has been developed an acoustic microscope which utilizes the transmissibility of an ultrasonic wave through a specimen as well as the modulation of the ultrasonic wave due to the elastic characteristics of the specimen. With the aid of such an acoustic microscope it is possible to observe an image of the elastic specimen at a high resolution. The frequency of the ultrasonic wave used in the acoustic microscope is usually set to several hundred megahertz, but recently an acoustic microscope using ultrasonic waves of very high frequency, e.g., up to the order of gigahertz has been developed. For instance, when water is used as the liquid medium between the acoustic lens and the specimen, it is possible to obtain a high resolution of about 1 μm by using an ultrasonic wave of 1 GHz. Such a resolution is comparable with that of usual optical microscopes. If liquid helium or liquid nitrogen is inserted between the acoustic lens and the specimen, there is a possibility that a higher resolution than 1 μm could be attained.

FIG. 1 is a schematic view showing a typical known acoustic microscope. An acoustic lens 1 comprises an ultrasonic wave propagating solid state medium 2 made of material such as sapphire and fused quartz having a high acoustic propagation velocity, an electric-acoustic piezoelectric transducer 3 applied on one end surface of the solid state medium 2, and a lens portion 4 formed in the other end surface of the solid state medium 2. A high frequency pulse generated by a high frequency pulse generator 5 is supplied to the transducer 3 via a circulator 6, and the transducer 3 produces a plane ultrasonic wave. The ultrasonic wave propagates within the solid state medium 2 and is converged into a spherical wave by the spherical lens portion 4. Between the acoustic lens 1 and a specimen 9 is placed an acoustic wave propagating liquid medium 10 such as water, and the converted spherical wave is projected onto the specimen 9 as a microscopic spot via the liquid medium 10. In the acoustic microscope of the reflection type, the ultrasonic wave reflected by the specimen 9 is collected by the lens portion 4, and then is made incident upon the transducer 3 which converts the received ultrasonic wave into an electric signal. The electric signal is then supplied to a signal processing circuit 7 via the circulator 6 and the signal processing circuit produces a video signal. The video signal is then supplied to a monitor 8 to display an ultrasonic image of the specimen 9. When the acoustic lens 1 and specimen 9 are moved two-dimensionally relative to each other to effect the mechanical scan, a two-dimensional image of the specimen due to the elasticity can be displayed.

In the reflection type acoustic microscope, when the acoustic beam is focused onto a surface of the specimen, it is possible to obtain the acoustic image having a construct in accordance with the difference in the reflection factor for the acoustic wave of the specimen surface. When the specimen is brought closer to the acoustic lens, the incident angle of the spherical acoustic wave emanating from the acoustic lens and impinging upon the specimen changes continuously from 0° to an angle formed between the outermost beam and a principal axis of the acoustic wave. Then the acoustic wave reflected by the specimen is modulated by various components in the specimen in different manners, and the reflected acoustic wave has a phase variation specific to the composition of the specimen. Therefore, by effecting the X-Y scan, it is possible to obtain an image having a contrast in accordance with the acoustic property of substances in the specimen. Further, when the acoustic lens is moved in the direction Z normal to the surface of the specimen to effect a linear scan and an output signal from the acoustic lens is plotted versus the distance in the direction Z, it is possible to attain a so-called V(Z) curve which is specific to the specimen. The above mentioned three functions of the acoustic microscope are very important. For instance, from the acoustic image of the specimen surface, it is possible to detect defects in the specimen surface. When the specimen surface is placed closer to the acoustic lens than the focal point, crystal construction and crystal boundary can be detected from the acoustic image. Moreover, from the V(Z) curve, one can specify or identify or more components in the specimen.

Various studies have been done for the acoustic lens for use in the acoustic microscope, and various acoustic lenses and analyses thereof have been disclosed in the following references.

(1) "ACOUSTIC MICROSCOPY BY MECHANICAL SCANNING", by R. A. Lemons, May 1975, Microwave Laboratory, W. W. Hansen Laboratories of Physics, Stanford University Stanford, Calif.

(2) "CHARACTERISTIC MATERIAL SIGNATURES BY ACOUSTIC MICROSCOPE" by R. D. Weglein and R. G. Wilson in "ELECTRONICS LETTERS", Vol. 14, No. 12, June 6, 1978.

(3) "An Angular-spectrum approach to contrast in reflection acoustic microscopy" by Abdallah Atalar in "JOURNAL OF THE APPLIED PHYSICS", Vol. 49. No. 10, pp 5130–5139, October 1978.

(4) "MODULATION TRANSFER FUNCTION FOR THE ACOUSTIC MICROSCOPE" by Abdallah Atalar in "ELECTRONICS LETTERS", Vol. 15, No. 11, May 24, 1979.

(5) "RAY INTERPRETATION OF THE MATERIAL SIGNATURE IN THE ACOUSTIC MICROSCOPE" by W. Parmon and H. L. Berton in "ELECTRONICS LETTERS", Vol. 15, No. 21, Oct. 11, 1979.

(6) Japanese Patent Application Laid-Open Publication (Kokai) No. 58-44,343.

(7) Japanese Patent Application Laid-Open Publication No. 60-149,963, Japanese Patent Publication No. 59-50,937 and Japanese Utility Model Application Laid-Open Publication No. 57-120,250.

In reference (1), there is disclosed an acoustic lens as shown in FIG. 2 of the present application. The acoustic lens comprises a sapphire rod ($Al_2O_3$) 11, an Au electrode 12 applied on one end surface of the rod, a piezoelectric film 13 (ZnO) applied on the Au electrode 12, and an Al electrode 14 applied on the ZnO film 13. In the other end surface of the rod 11 there is formed a spherical lens portion 15. The dimension of the electric-acoustic transducer is defined by the dimension of the uppermost Al electrode 14. As the acoustic lens for 1 GHz, the following parameters have been proposed:

$l=2.00$ mm
$r=0.135$ mm
$\theta_{max}=50°$
$D=0.207$ mm
$d=0.156$ mm wherein l is the length of the acoustic wave propagating solid state medium 11, r is the radius of curvature of the spherical lens portion 15, $\theta$ is the aperture angle, D is the aperture diameter and d is the focal distance. This known acoustic lens has the F/number, defined by d/D, of 0.75. In this acoustic lens, the acoustic energy impinging upon portions outside the aperture of the lens portion 15 becomes useless and might interfere with the acoustic energy passing through the lens portion 15. Therefore, when designing the acoustic lens, the dimension of the transducer, i.e. the diameter of the Al electrode 14, has to be adjusted such that the above-mentioned disturbing acoustic energy is minimized. Further, in order to protect the acoustic lens from damage or breakdown, the above dimension must be determined such that the acoustic energy is spread as widely as possible. In order to satisfy such requirements, it has been recommended that the diameter of the Al electrode 14 be made substantially equal to the aperture diameter D of the lens portion 15 and the length l of the medium 11 be selected such that the lens aperture is situated just in a Fresnel focal point or slightly longer than that. Here, the Fresnel focal distance $l_0$ is given by $l_0=\rho_0^2/\lambda$, where $\rho_0$ is the radius of the Al electrode 14 and $\lambda$ is the wavelength of the acoustic wave to be used. In this case, the diameter of the acoustic wave becomes substantially equal to the diameter of the transducer at the Fresnel focal distance. As stated above, in the known acoustic lens, the diameter of the transducer is made substantially equal to the aperture of the spherical lens portion 15 and the length of the medium 11 is made substantially equal to the Fresnel focal distance, so that uniform intensity distribution of acoustic energy can be obtained at the lens portion 15. This is the basic design principle of the known acoustic lens. This principle has been equally applied to known acoustic lenses described in references (2) to (5) and (7).

In reference (6) there is disclosed an acoustic lens in which the length of the ultrasonic wave propagating rod is set to the inverse of an odd number, particularly one third ($\frac{1}{3}$) of the Fresnel focal distance and the aperture diameter of the lens portion is set also to the inverse of an odd number, particularly one third ($\frac{1}{3}$) of the diameter of the transducer. This known acoustic lens has been developed in order to solve the following problem. In order to reduce the dumping of the acoustic energy in the water inserted between the lens and specimen, it is advantageous to shorten the working distance. Then, the radius of the lens portion and the aperture diameter have to be reduced, so that the radius of the transducer becomes shorter accordingly. However, an acoustic lens having such a small transducer and lens portion cannot be practically manufactured or can be manufactured only with difficulty. In the acoustic lens shown in the reference (6), the above-mentioned problem is solved by increasing the dimension of the transducer. However, it should be noted that in this known acoustic lens, the previously mentioned principle that the amplitude of the acoustic energy becomes uniform at the lens portion has been equally applied.

As explained above, upon designing the acoustic lens it is preliminarily noted that the simplest or uniform distribution of the acoustic energy can be attained at the lens portion and that the acoustical field at other portions has been neglected. Particularly, the known acoustic lenses have been designed without taking into account the phase of the acoustical field. Therefore, it is practically impossible to design various acoustic lenses which can be advantageously used in various applications and satisfy various requirements. In practice, almost all acoustic lenses have been manufactured in such a manner that the aperture diameter of the lens portion is made substantially equal to the diameter of the transducer and the length of the ultrasonic wave propagating solid state medium is made substantially equal to the Fresnel focal distance. That is to say, the known acoustic lenses have been manufactured by determining various parameters such as frequency, aperture diameter and aperture angle in accordance with the above mentioned design principle and the lenses thus manufactured were set to actual acoustic microscopes to check whether or not the required conditions would be satisfied. In general, the known acoustic lenses manufactured in the manner explained above were not satisfactory. Then new acoustic lenses had to be manufactured again by changing one or more parameters. In this manner, the known acoustic lenses were manufactured by a trial and error method. It is apparent that such a process is quite cumbersome and requires a very long time, and sometimes desired acoustic lenses could not be obtained. Particularly, in the acoustic lens for obtaining the V(Z) curve the phase of the acoustical field is very important, and not only does the acoustic wave have to be in-phase at the spherical lens portion, but also the amplitude of the acoustic energy has to be sufficiently large at the spherical lens portion. However, it is practically difficult to obtain an acoustic lens satisfying such conditions. This is mainly due to the fact that, according to the known design principle, the lens aperture has to be small for making the acoustic wave in-phase at the lens aperture, and therefore the amplitude or power of the acoustic wave becomes weak. However, no study has been done for finding the maximum permissible phase difference.

SUMMARY OF THE INVENTION

The present invention has for its object to provide a novel and useful acoustic lens which can satisfy various requirements for various applications, by statically analyzing the amplitude and phase properties of acoustic energy in the propagation path from the transducer to the specimen and from the specimen to the transducer.

It is another object of the invention to provide an acoustic lens which can attain a contrast due to variations in the amplitude and phase of the acoustic wave reflected by the specimen surface by normalizing the dimension of the transducer and the dimension of the lens aperture and the transducer can receive the acoustic wave modulated by the specimen with effective power and/or phase.

According to the invention, an acoustic lens for use in an acoustic microscope comprises an ultrasonic wave propagating solid state medium having opposed end surfaces, an electric-acoustic piezoelectric transducer provided on one end surface of the solid state medium, and a lens portion formed in the other end surface of the solid state medium; wherein the radius of the transducer is defined as a, the length of the solid state medium measured in an ultrasonic wave propagating direction from the transducer to the lens portion is l, the aperture radius of the lens portion is w, the wavelength of the ultrasonic wave is λ, $Z(=l\lambda/a^2)$ and $W(=w/a)$, being set to such a region in a first quadrant of Z-W coordinate system, excluding the region near the point (1,1), that an acoustical field having desired power and/or phase is obtained in the solid state medium. The first quadrant of a Z-W coordinate system is defined as the region of a graph of Z vs. W where both Z and W are positive values.

The inventors have confirmed that the point (Z,W) can be advantageously set in a region other than a region defined by the W axis, a line expressed by $W=Z$, and a line represented by $W=-5Z+3$. Furthermore, the known region near the point $Z=1$, $W=1$ is outside the scope of the invention. By selecting points (Z,W) within such a preferable region, it is possible to attain acoustic lenses having particularly large power.

Further, the inventors have found that the point (Z,W) is advantageously set within such a region in the first quadrant of the Z-W coordinate system that the phase difference is limited within 50°. Such an acoustic lens is particularly suitable for obtaining the V(Z) curve.

According to the known principle for designing the acoustic lens, the lens portion has to be arranged at a strictly defined position without taking into account the phase of the acoustic wave. According to the invention, the acoustic lens is designed by taking into account the phase and amplitude of the acoustic wave impinging upon the transducer. Particularly, in the acoustic lens for obtaining the V(Z) curve, the phase is much more important than the amplitude.

DESCRIPTION OF THE PREFERRED EMBODIMENTS

Figure 1:
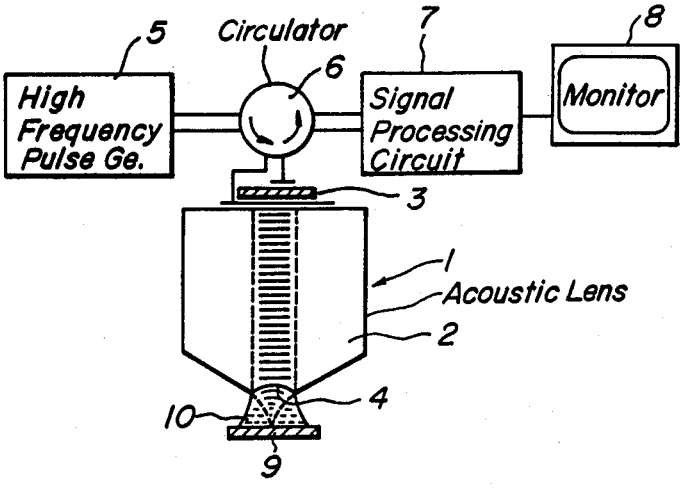
FIG. 1 PRIOR ART
FIG. 1 is a schematic view showing a general construction of the known acoustic microscope.
Figure 2:
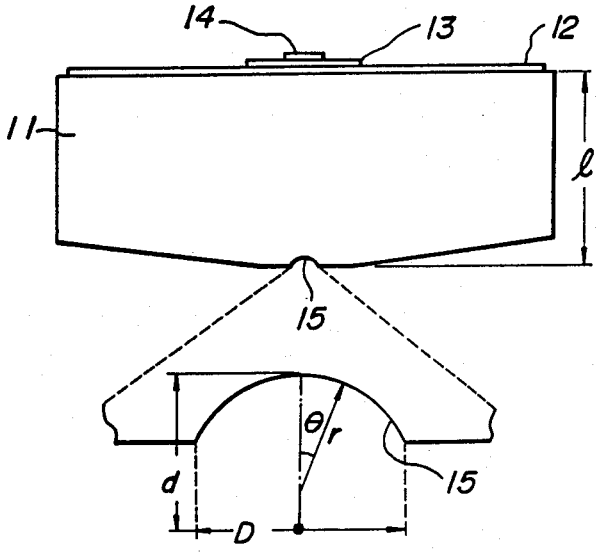
FIG. 2 PRIOR ART
FIG. 2 is a schematic view illustrating the known acoustic lens.
Figures 3, 4A:
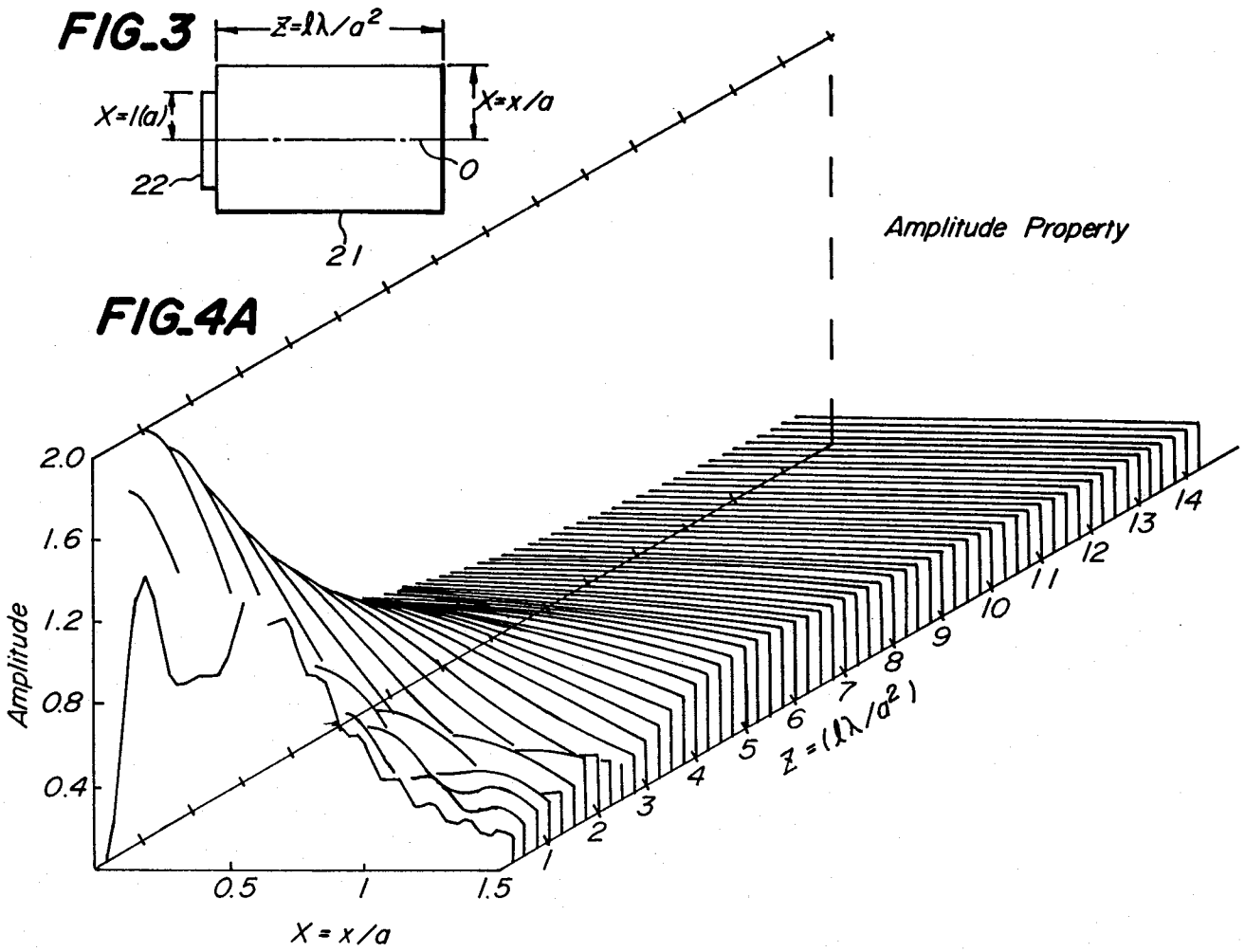
FIG. 3 is a schematic view for explaining the basic conception of the present invention.
FIGS. 4A and 4B and FIGS. 5A and 5B are graphs showing the amplitude and phase properties of the acoustic lens according to the invention.

Before explaining the present invention, the acoustical field distribution will be first explained. In order to derive an acoustical field u(x) of the acoustic energy emitted from an electric-acoustic piezoelectric transducer and propagating in an acoustic wave propagating solid state medium, an acoustical field due to a flat piston-shaped sound source having a circular cross section will be considered. It should be noted that the Lommel approximation for diffraction of light is also applied to the acoustical field. FIG. 3 is a schematic view showing a principal construction of the acoustic lens. In FIG. 3, a represents the radius of an electric-acoustic piezoelectric transducer 22 applied on one end surface of an acoustic wave propagating solid state medium 21, l represents the distance from the transducer 22 to the end of the solid state medium, measured along a central axis, o, x represents the distance from the central axis o to the edge of the propagating medium 21 in a direction perpendicular to the axis, and λ represent the is a wavelength of the acoustic wave. Two normalized amounts, X and Z, are defined as follows: $X=x/a$ and $Z=\lambda l/a^2$. The a sound pressure P can be expressed as follows:

$$P=\rho\cdot c\cdot\omega_0\cdot e^{i(\omega t-kz)}\cdot(u_1+iu_2) \tag{1}$$

wherein $$u_1 = 1-\cos\frac{\pi}{z}(1+x^2)\sum_{n=0}^{\infty}(-1)^n x^{2n}J_{2n}\left(2\pi\frac{x}{z}\right)- \sin\frac{\pi}{z}(1+x^2)\sum_{n=0}^{\infty}(-1)^n x^{2n+1}J_{2n+1}\left(2\pi\frac{x}{z}\right) x \leqq 1$$

or $$u_1 = \cos\frac{\pi}{z}(1+x^2)\sum_{n=1}^{\infty}(-1)^n x^{\frac{1}{2n}}J_{2n}\left(2\pi\frac{x}{z}\right)+ \sin\frac{\pi}{z}(1+x^2)\sum_{n=0}^{\infty}(-1)^n x^{\frac{1}{2n+1}}J_{2n+1}\left(2\pi\frac{x}{z}\right) x > 1$$

and $$u_2 = \sin\frac{\pi}{z}(1+x^2)\sum_{n=0}^{\infty}(-1)^n x^{2n}J_{2n}\left(2\pi\frac{x}{z}\right)- \cos\frac{\pi}{z}(1+x^2)\sum_{n=0}^{\infty}(-1)^n x^{2n+1}J_{2n+1}\left(2\pi\frac{x}{z}\right) x \leqq 1$$

or $$u_2 = \cos\frac{\pi}{z}(1+x^2)\sum_{n=0}^{\infty}(-1)^n x^{\frac{1}{2n+1}}J_{2n+1}\left(2\pi\frac{x}{z}\right)- \sin\frac{\pi}{z}(1+x^2)\sum_{n=0}^{\infty}(-1)^n x^{\frac{1}{2n+1}}J_{2n+1}\left(2\pi\frac{x}{z}\right) x > 1$$

In the above equation, $\rho$ is the density of the liquid medium between the acoustic lens and the specimen, C is the velocity in the liquid medium and $k=2\pi/\lambda$.

According to the invention, in the acoustical field generated by the electric-acoustic transducer having a radius of a, a lens aperture w is arranged at a distance Z from the transducer and then the influence of the lens aperture upon the acoustic field is calculated, while the normalization of $W=w/a$ is taken place.

By using the parameters W and Z thus normalized, the known acoustic lenses will be first analyzed. The first reference (1) mentions the $W=1$ and $Z=1$ or $Z>1$ (but near 1). The other references also describe the same principle in design that W is set to 1 and Z is set to 1 or slightly larger than 1. The inventors have found that points other than $Z=1$, $W=1$ can yield acoustic lenses having unexpected properties.

Figure 4B:
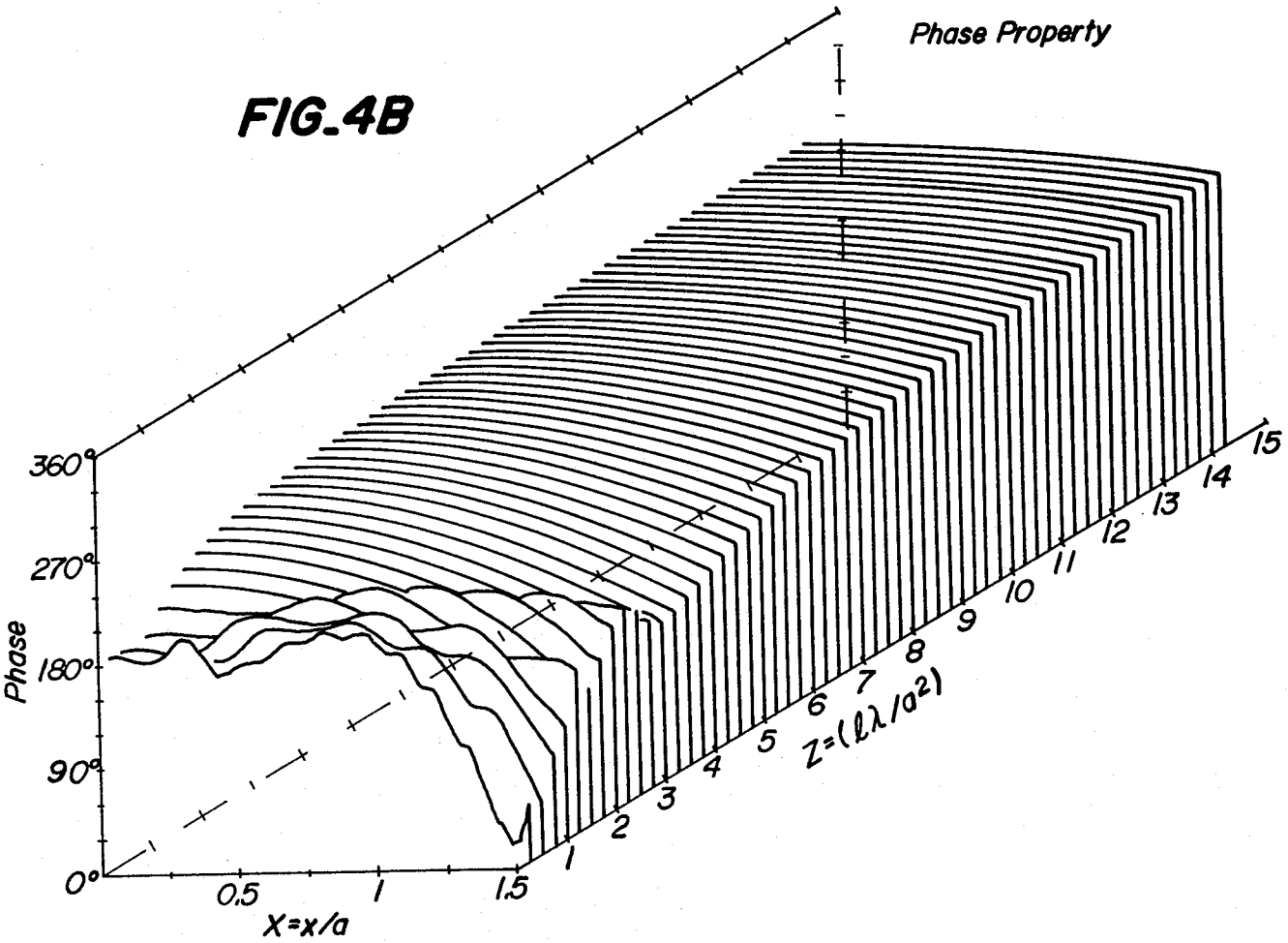
Figure 5A:
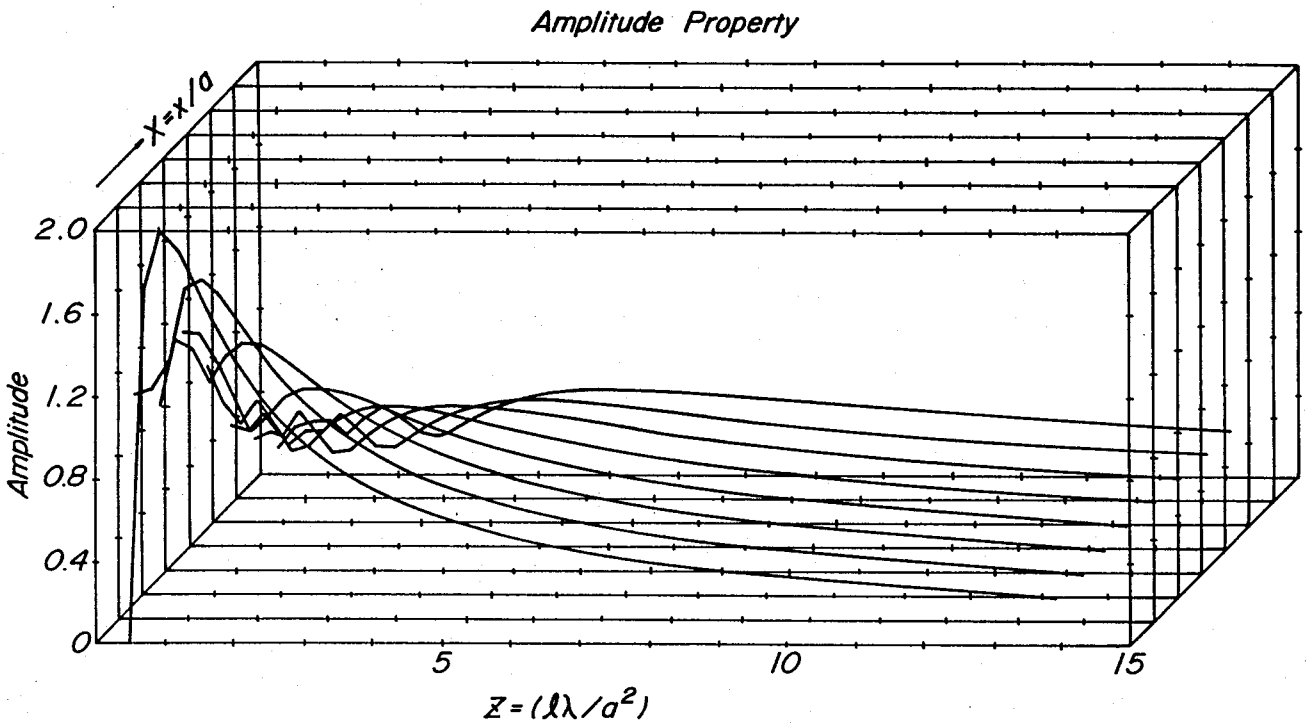
Figure 5B:
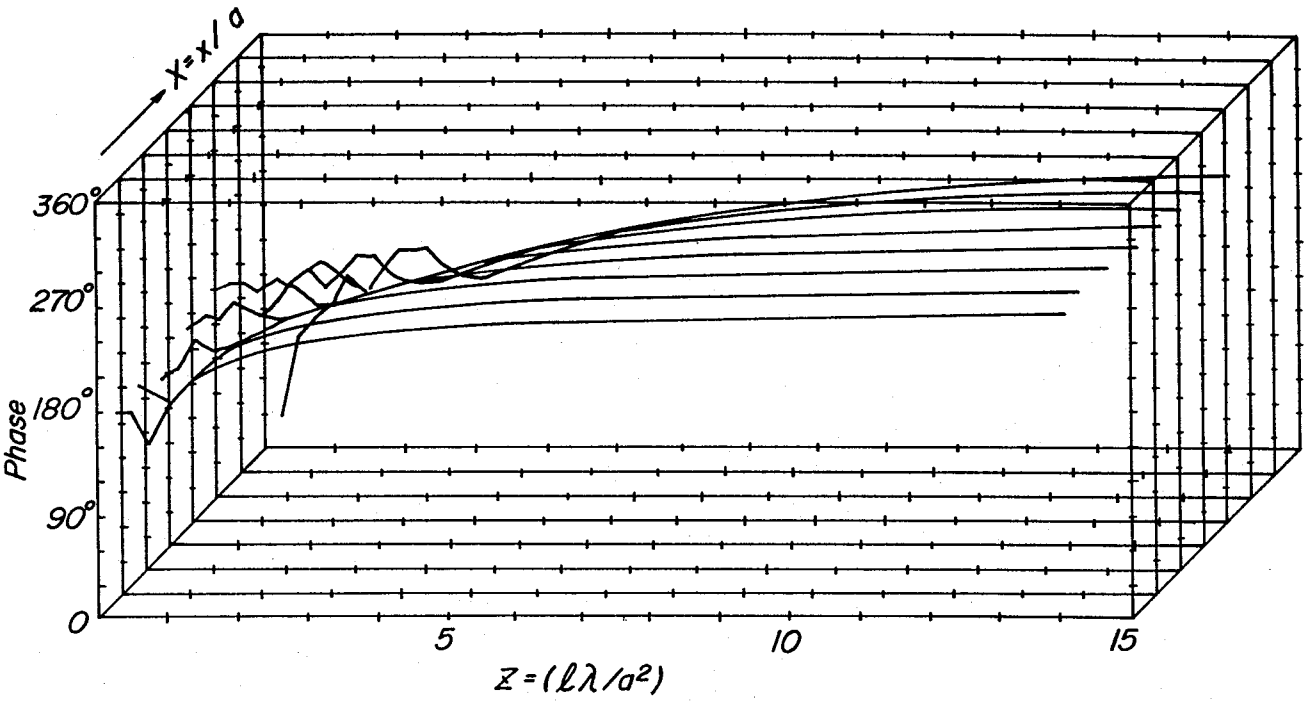
Figure 6A:
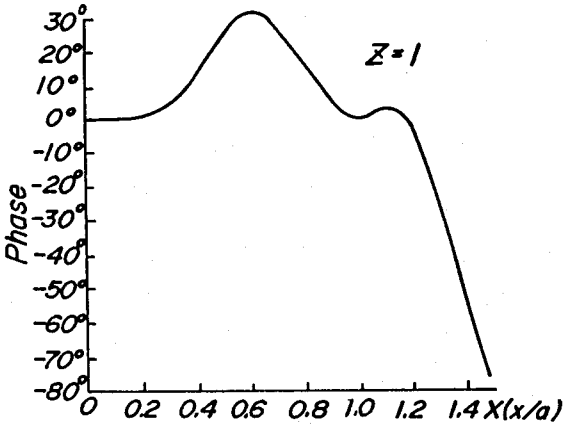
FIGS. 6A to 6L are graphs representing the relationship between X and phase for various values of Z.
Figure 6B:
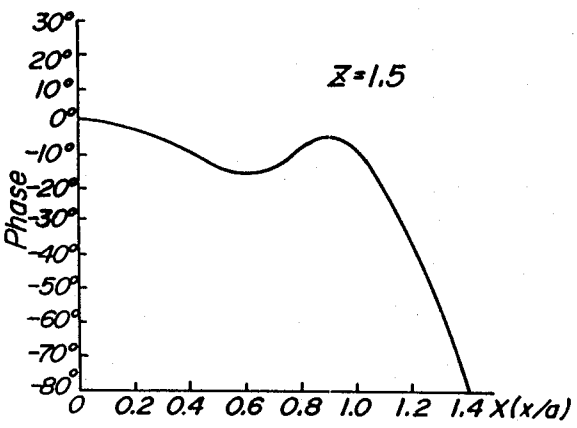
Figure 6C:
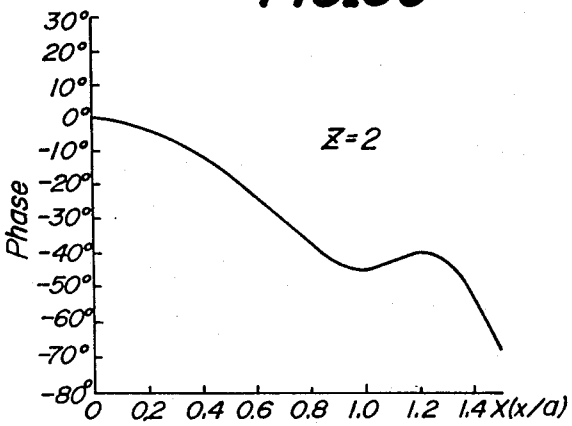
Figure 6D:
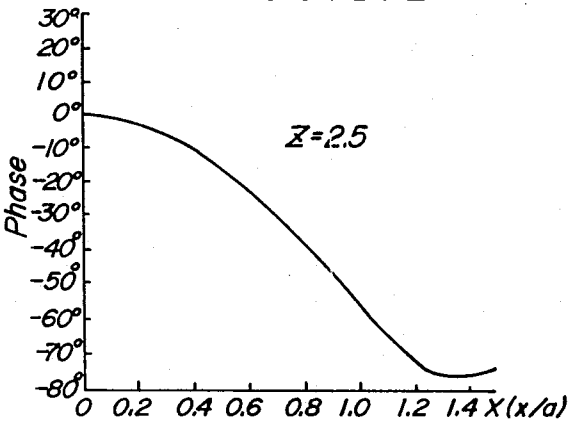
Figure 6E:
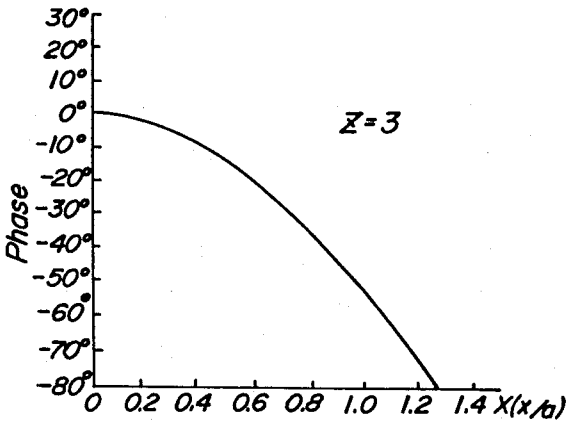
Figure 6F:
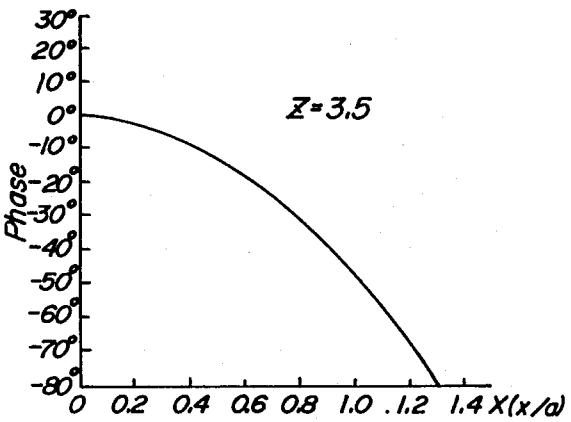
Figure 6G:
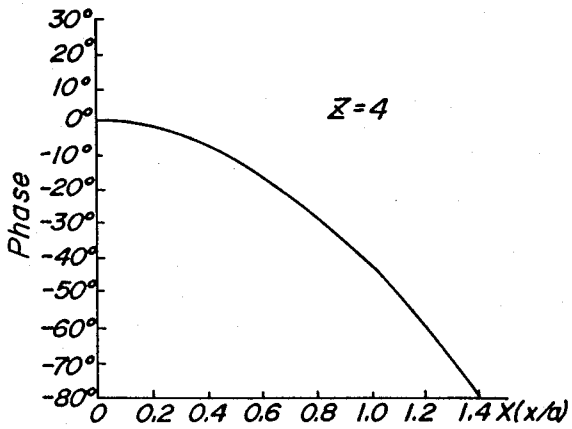
Figure 6H:
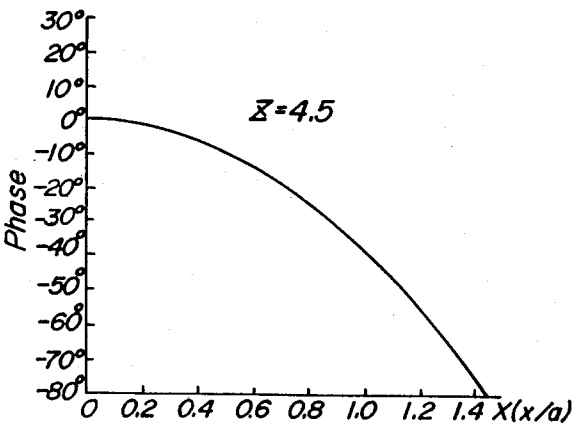
Figure 6J:
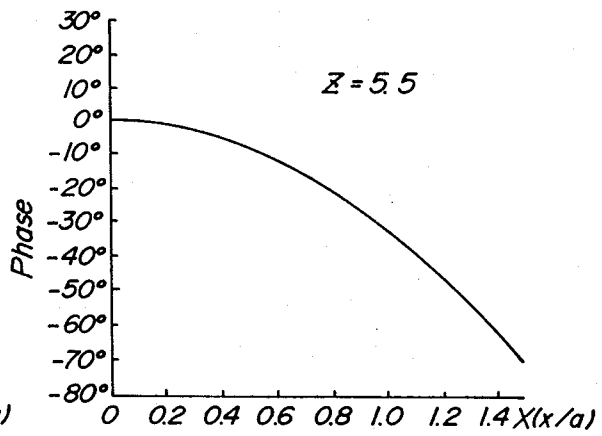
Figure 6I:
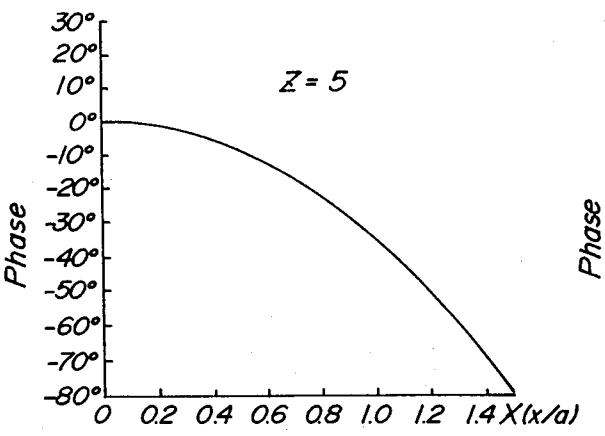
Figure 6L:
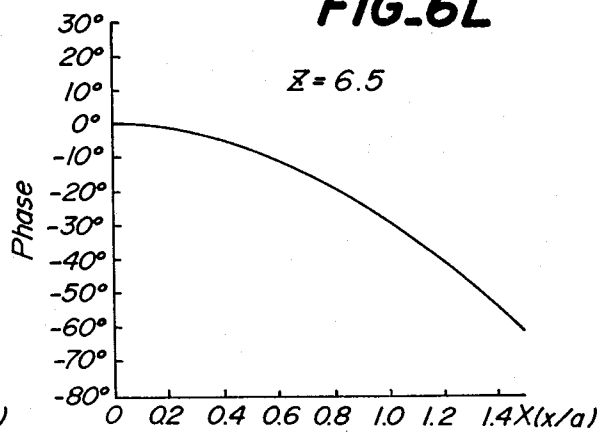
Figure 6K:
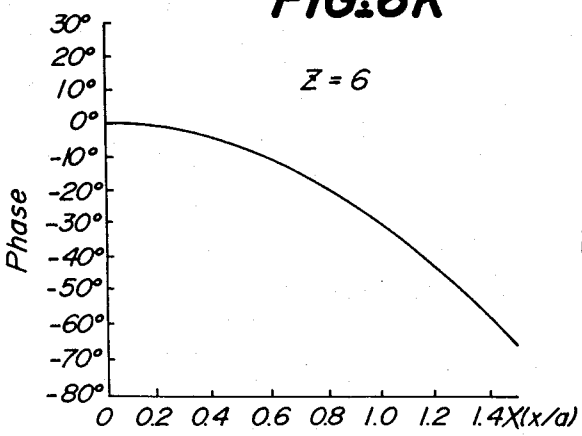

The above equation (1) was calculated to derive the amplitude and phase of the acoustic wave. Amplitude and phase are represented three-dimensionally in FIGS. 4A and 4B, respectively. Where 2 is less than 1 the amplitude and phase fluctuate largely and at $Z-1$ the maximum sound pressure is obtained. In order to show the condition of the sound pressure in greater detail, FIGS. 5A and 5B illustrate the amplitude and phase properties, respectively at $X=0.2$, 0.4, 0.8, 1.0, 1.2 and 1.4. Further, according to the invention, the phase is the important property, so that the phase variations at $Z=1$, 1.5, 2, 2.5, 3, 3.5, 4, 4.5, 5, 5.5, 6, 6.5 are also shown in FIGS. 6A~6L. In these graphs the phase at $X=0$ is normalized into 0°. From the graphs shown in FIGS. 4, 5 and 6, it can be understood that the acoustic wave becomes in-phase to a greater extent in accordance with the increase of Z, but the amplitude becomes gradually smaller.

Figure 7:
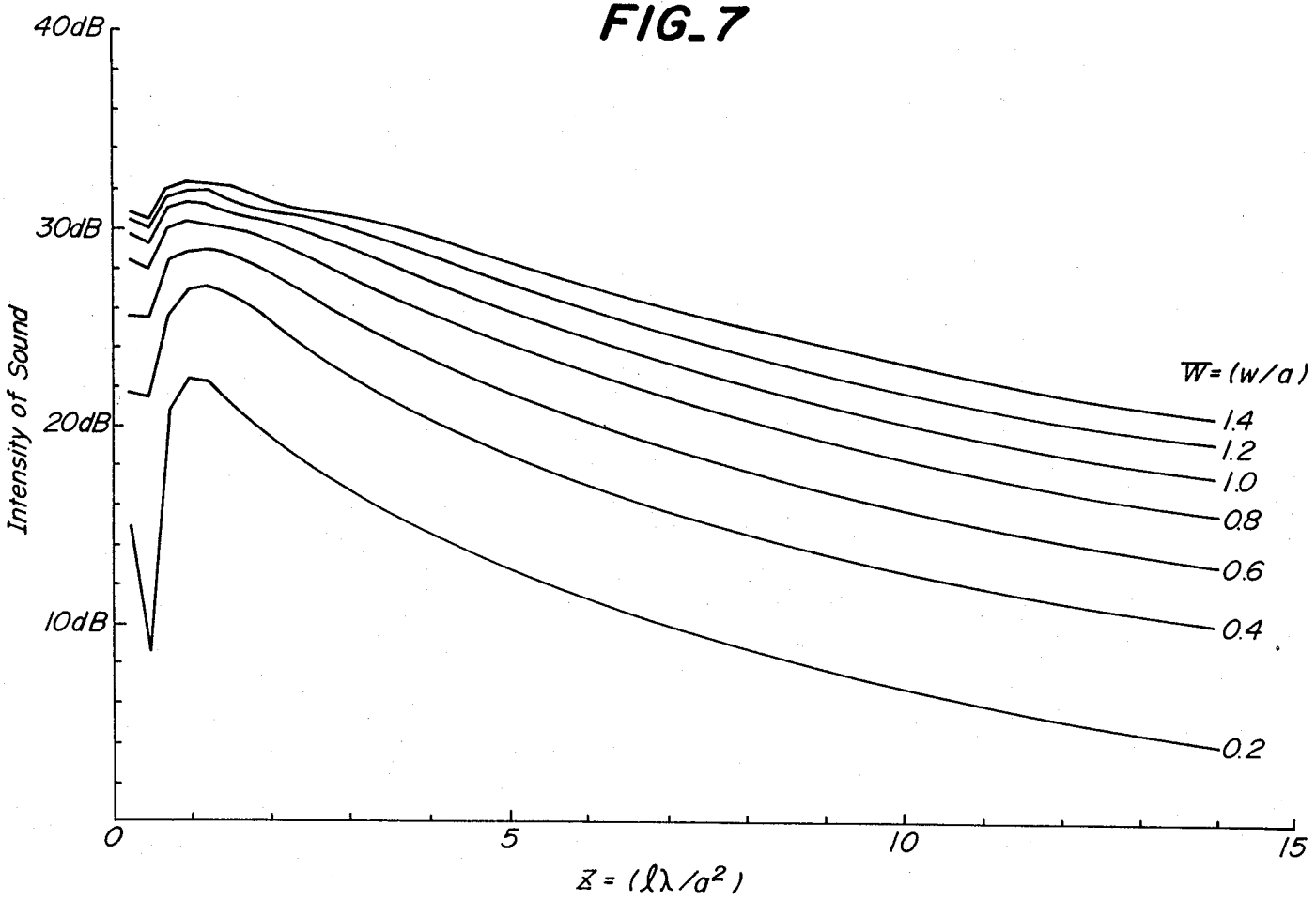
FIG. 7 is a graph illustrating the relationship between Z and acoustical intensity for various values of W.
Figure 8A:
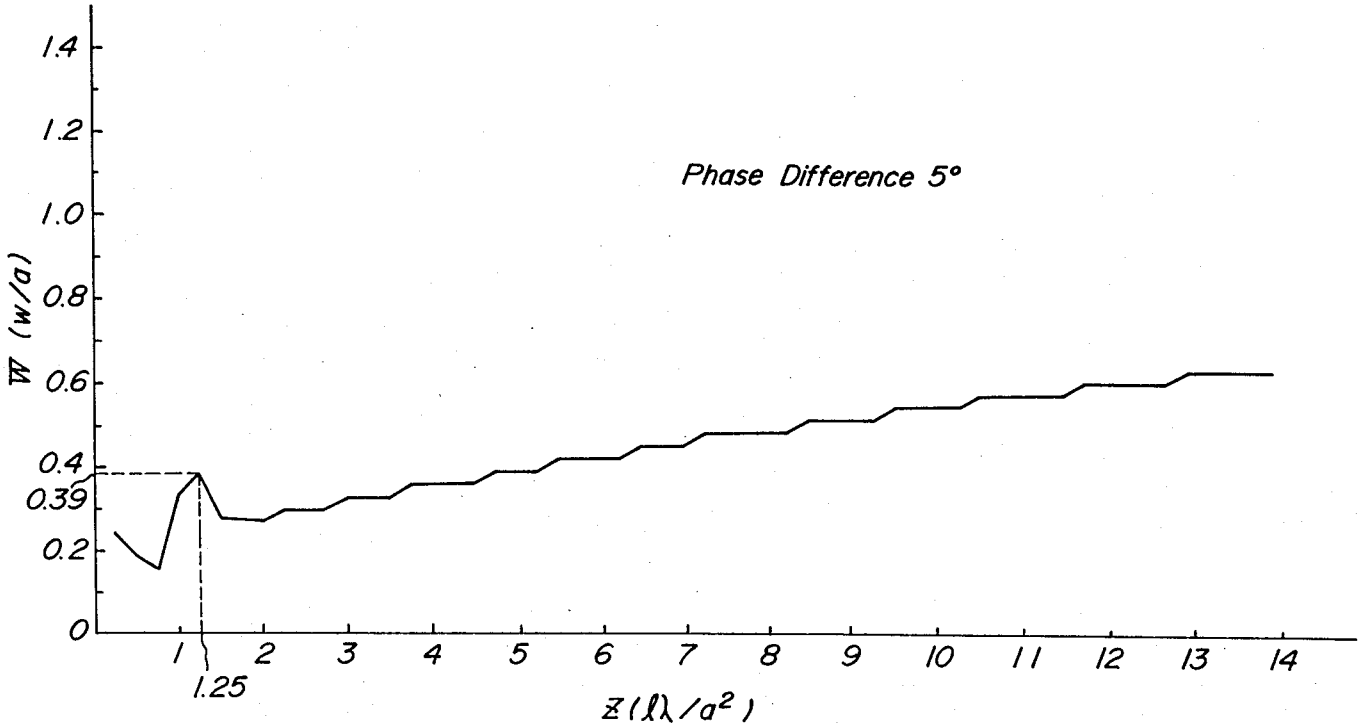
FIGS. 8A and 8B are graphs expressing the relationship between Z and W and that between Z and power at a phase difference of 5°.
Figure 8B:
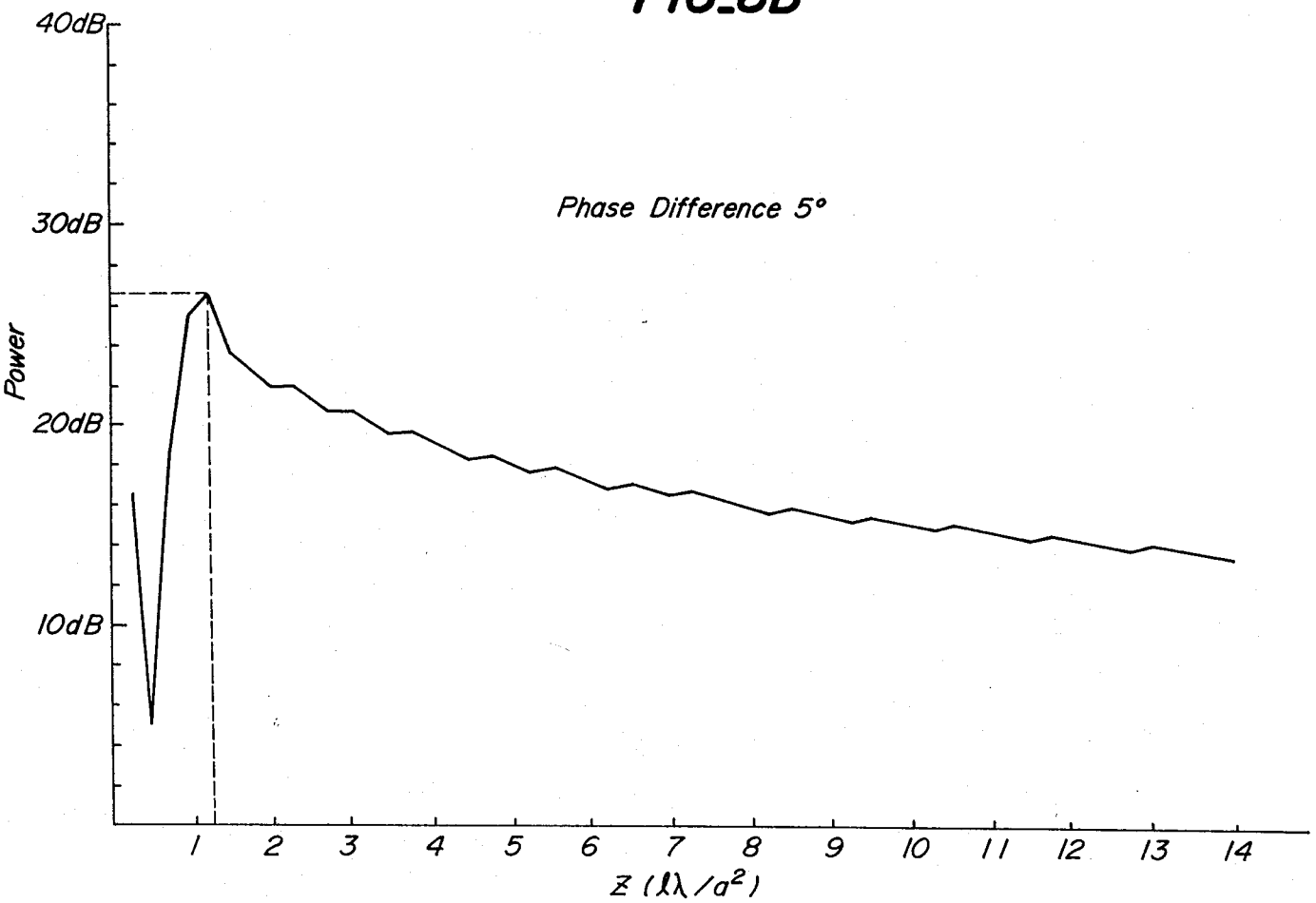

In order to derive the power of the acoustic wave immediately after the lens aperture, a value (u) of a summation of all sound pressure within the aperture radius w at a position separated from the transducer by a distance Z is first calculated and then a value of 20 log (u) is calculated. FIG. 7 illustrates a relationship between the intensity, i.e., power of the acoustic wave, and the distance Z at $W=0.2$, 0.4, 0.6, 0.8, 1.0, 1.2 and 1.4, while the normalization of $W=w/a$ is effected. In FIG. 7, the vertical axis denotes the power, i.e., the intensity of sound, and the power becomes larger in accordance with the increase in W. But when W is increased, the phase difference becomes larger. In the case of deriving the V(Z) curve, the phase of the acoustic field becomes important. For the acoustic lens, the acoustic wave is in-phase and has a large power at the aperture of the lens portion. In order to investigate this further in detail, the relationship between W and Z as well as the relationship between the power and Z were derived at various phase differences. FIGS. 8A and 8B illustrate the relationship between W and Z and the power and Z at a phase difference at 5°. At first, a value of $Z(Z=1.25)$ which gives the maximum power was derived from the graph shown in FIG. 8B, and then a value of $W(W=0.39)$ corresponding to the thus derived Z was found from the graph illustrated in FIG. 8A. In this manner, the values of W and Z giving the maximum power can be derived. The following Table 1 shows various values of W and Z for phase differences of 10°, 15°, 20°, 25°, 30°, 40′ and 60°.

TABLE 1

| phase difference | Z | W | maximum power (dB) |
|---|---|---|---|
| 5° | 1.25 | 0.39 | 26.7 |
| 10° | 1.25 | 0.69 | 29.6 |
| 15° | 1.25 | 0.93 | 31 |
| 20° | 1.5 | 1.11 | 31.3 |
| 25° | 1.5 | 1.14 | 31.4 |
| 30° | 1.5 | 1.18 | 31.5 |
| 40° | 1 | 1.2 | 32 |
| 60° | 1 | 1.3 | 32.3 |

In the above Table 1, the maximum power is represented by 20 log (u), so that the power of the acoustical field becomes larger in accordance with the increase of the maximum power. For instance, the power at the phase difference of 10° is larger than that at the phase difference of 5° by 2.9 dB (=29.6–26.7). However, the inventors have further confirmed that calculated values and characteristics of acoustic lenses calculated by $W\neq1$, i.e., $a\neq w$ do not correspond to those of actual acoustic lenses.

The inventors have further investigated and found a process of approximating theoretically calculated acoustic lens to actual lenses for wide variations other than $W=1$ and $Z=1$ on the basis of the calculation method disclosed in the above mentioned reference (3). It should be noted that the reference (3) merely teaches a method of estimating acoustic lenses manufactured in accordance with the known design principle of $W=1$ and $Z=1$ or slightly larger than 1, and does not teach a general guideline for designing acousting lenses. By using the newly developed approximating method, the inventors have explored the possibility of practical acoustic lenses having values of Z and W which vary over a wide region other than region near the point $(Z,W)=(1,1)$.

Figure 9:
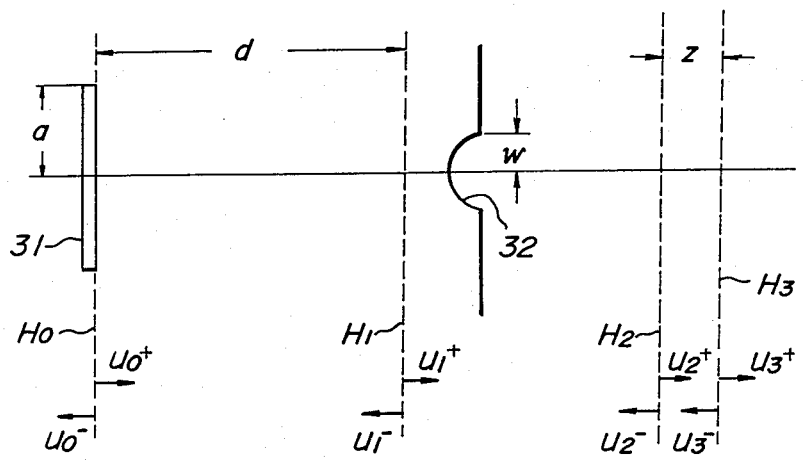
FIG. 9 is a schematic view for explaining the theoretical expansion of the design concept of the acoustic lens according to the invention.

FIG. 9 is a schematic view for explaining a theoretical calculation process performed by the inventors. In this process, the acoustic fields at four planes $H_0$~$H_3$ are considered. $H_0$ is a plane of a transducer 31 having a radius a and $H_1$ and $H_2$ are back and front focal planes of the lens. $H_3$ is a plane separated from $H_2$ by a distance Z. The reflection of the acoustic wave is carried out at this plane $H_3$. A lens portion 32 has an aperture radius of w, pupil function $P_1$ for the acoustic wave impinging upon the specimen and a pupil function $P_2$ for the acoustic wave reflected by the specimen. The planes $H_0$ and $H_1$ are separated from each other by a distance d. Then acoustical fields $u_1+$, $u_2+$, $u_3+$, $u_1-$, $u_2-$ and $u_3-$ of the incident acoustic wave and the reflected acoustic wave at these planes are calculated. $u_1+$ is the acoustical field emitted by the transducer 31 and impinging upon the plane $H_1$. Assuming that the acoustic lens is sufficiently thin, the acoustic lens can be considered to be a phase converting element which converts an incident plane wave into a spherical wave. Then, the acoustical field $u_2+$ at the front focal point plane $H_2$ can be expressed as follows:

$$u_2^+(x,y) = \frac{\exp[ik_0 f(1+\bar{c}^2)]}{i\lambda_0 f} F[u_1^+(x,y)P_1(x,y)] \quad (2)$$

In this equation (2), $k_0$ is equal to $2\pi/\lambda_0$ ($\lambda_0$ is the wavelength of the acoustic wave in the liquid medium), f is a focal distance, $R_e$ is the radius of curvature of the lens portion 32, and $\bar{c}$ is the ratio of the velocity of the acoustic wave in water to that in the solid state medium. Then the following relation is given:

$$f=R_e|(1-\bar{c})$$

The propagation of the acoustic energy from the plane $H_2$ to the plane $H_3$ can be simply calculated by using angular-spectrum. When the acoustical field $u_2^+(x,y)$ is Fourier transformed, the following equation is obtained:

$$u_2^+(k_x,k_y)=F[u_2^+(x,y)]$$

Then $u_3^+(k_x,k_y)$ can be expressed as follows.

$$u_3^+(k_x,k_y)=u_2^+(k_x,k_y)\exp[ik_z'z] \quad (3)$$

Now, it is assumed that $k_z'=k_z+\alpha_z$ and $k_z=\sqrt{k_0^2-k_x^2-k_y^2}$, the equation (3) can be rewritten in the following manner:

$$u_3^+(k_x,k_y)=u_2^+(k_x,k_y)\exp\left[z\left(\frac{-a}{k_0}+i\right)\sqrt{k_o^2-k_x^2-k_y^2}\right]$$

wherein $\alpha$ is an attenuation constant.

Here, the following approximation can be applied:

$$\sqrt{k_0^2-k_x^2-k_y^2}\approx k_0-\tfrac{1}{2}\left(\frac{k_x^2+k_y^2}{k_0}\right)$$

Then the equation (3) can be rewritten in the following manner:

$$u_3^+(k_x,k_y)=u_2^+(k_x,k_y)\exp\left(-za+a_z\frac{k_x^2+k_y^2}{2k_0^2}\right)\exp(ik_0z)\exp\left\{-i\frac{k_x^2+k_y^2}{2k_0}z\right\} \quad (4)$$

Therefore, the acoustical field $u_3^-$ reflected by the specimen surface plane $H_3$ can be expressed as follows:

$$u_3^-(k_x,k_y)=u_3^+(k_x,k_y)R(k_x/k_0,k_y/k_0) \quad (5)$$

In this equation (5) R denotes the reflective function. Next, the acoustical field $u_2^-$ impinging upon the plane $H_2$ can be represented by the following equation (6):

$$u_2^-(k_x,k_y)=u_3^-(k_x,k_y)\exp[ik'_zz]=u_3^-(k_x,k_y)\exp\left(-za+az\frac{k_x^2+k_y^2}{2k_0^2}\right)\exp(ik_0z)\exp\left\{-i\frac{k_x^2+k_y^2}{2k_0}z\right\} \quad (6)$$

In order to derive the acoustical function $u_1^-(x,y)$, $u_2^-(k_x,k_y)$ is first inversely Fourier transformed to derive $u_2^-(x,y)$. That is to say, $u_2^-(x,y)$ may be derived by the following equation (7):

$$u_2^-(x,y)=F^{-1}[u_2^-(k_x,k_y)] \quad (7)$$

$u_1^-(x,y)$ at the plane $H_1$ can be expressed by the following equation (8) similar to the equation (2):

$$u_1^-(x,y)=\frac{\exp[ik_0f(1+\bar{c}^2)]}{i\lambda_0f}P_2(x,y)u_2^-(k_0x/f,\ k_0y/f) \quad (8)$$

Further, $u_0^-$ at the plane $H_0$ can be given by the following equation (9):

$$u_0^-(k_x,k_y)=u_1^-(k_x,k_y)\exp[ik_zd] \quad (9)$$

The above equation (9) may be rewritten into the following equation (10) by using the convolution theorem:

$$u_0^-(x,y)=u_1^-(x,y)\otimes F^{-1}[\exp(ik_zd)] \quad (10)$$

It should be noted that the voltage generated by the piezoelectric transducer is an integration of products of weight function S(x,y) of the piezoelectric transducer and $u_0^-(x,y)$. Here, the weight function S(x,y) represents an acoustical field which is generated by the transducer when a unit voltage is applied to the transducer and can be expressed as follows:

$$S(x,y)=U_0^+(x,y)$$

Therefore, the output voltage V(Z) from the transducer can be expressed as follows:

$$\begin{aligned}V(Z) &= \int_{-\infty}^{\infty}\int u_0^+(x,y)u_0^-(x,y)dxdy\\ &= e^{-2dz}\int_{-\infty}^{\infty}\int u_1^+(-x,-y)u_1^-(x,y)\,P_1(-x,-y)P_2(x,y)R(x/f,y/f)dxdy\end{aligned}$$

Now the above equation V(Z) can be rewritten as follows by effecting the replacement of $R(x/f, y/f)=R(k_1/k_0)$, $u_1^+(x,y)=u_1^+(r)$, $P(x,y)=P(r)$ and $r=(x^2+y^2)^{\frac{1}{2}}$:

$$V(Z)=e^{-2az}\int_0^{\infty}[r(u_1^+(r)]^2P_1(r)P_2(r)R(r/f)\exp\left[-i\left(\frac{k_0z}{f^2}\right)r^2\right]\exp\left[\frac{azr^2}{f^2}\right]dr \quad (11)$$

Figure 10:
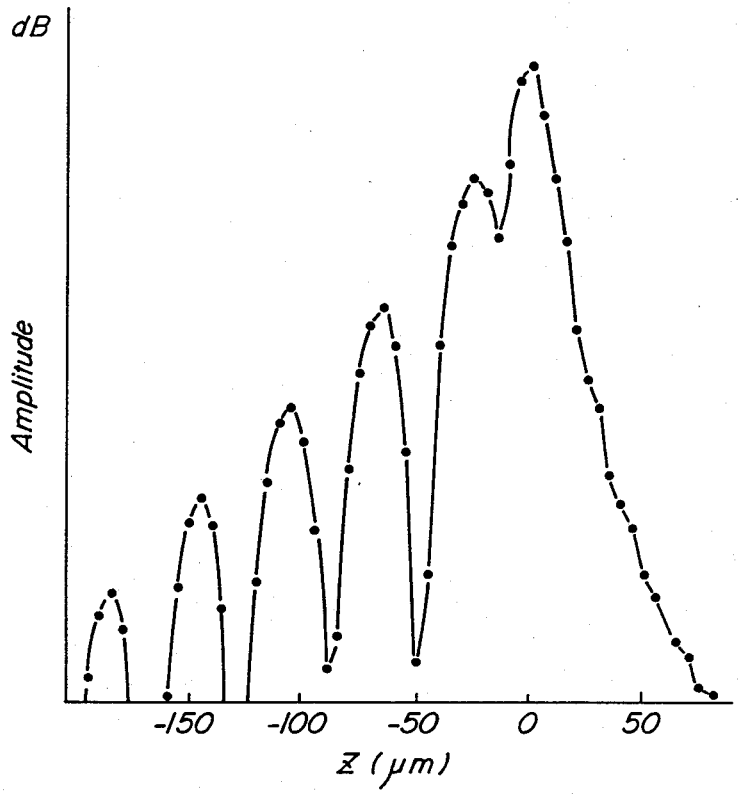
FIG. 10 is a graph showing the V(Z) curve derived from the theoretical calculation.

Further values of V(Z) are theoretically calculated for various values of W and Z by taking into account the pupil functions $P_1$ and $P_2$ together with anti-reflection layer and spherical aberration of the lens portion. An example of a V(Z) curve thus calculated is shown in FIG. 10. This curve is calculated by using an acoustic lens having an acoustic wave propagating solid state medium made of fused quartz having a length of $l=6.7$ mm, a transducer having a diameter $2a=0.766$ mm, a radius of curvature $RA=0.5$, and an aperture angle $SI=60°$. The frequency of the acoustic wave is selected to be 200 MHz.

Figure 11:
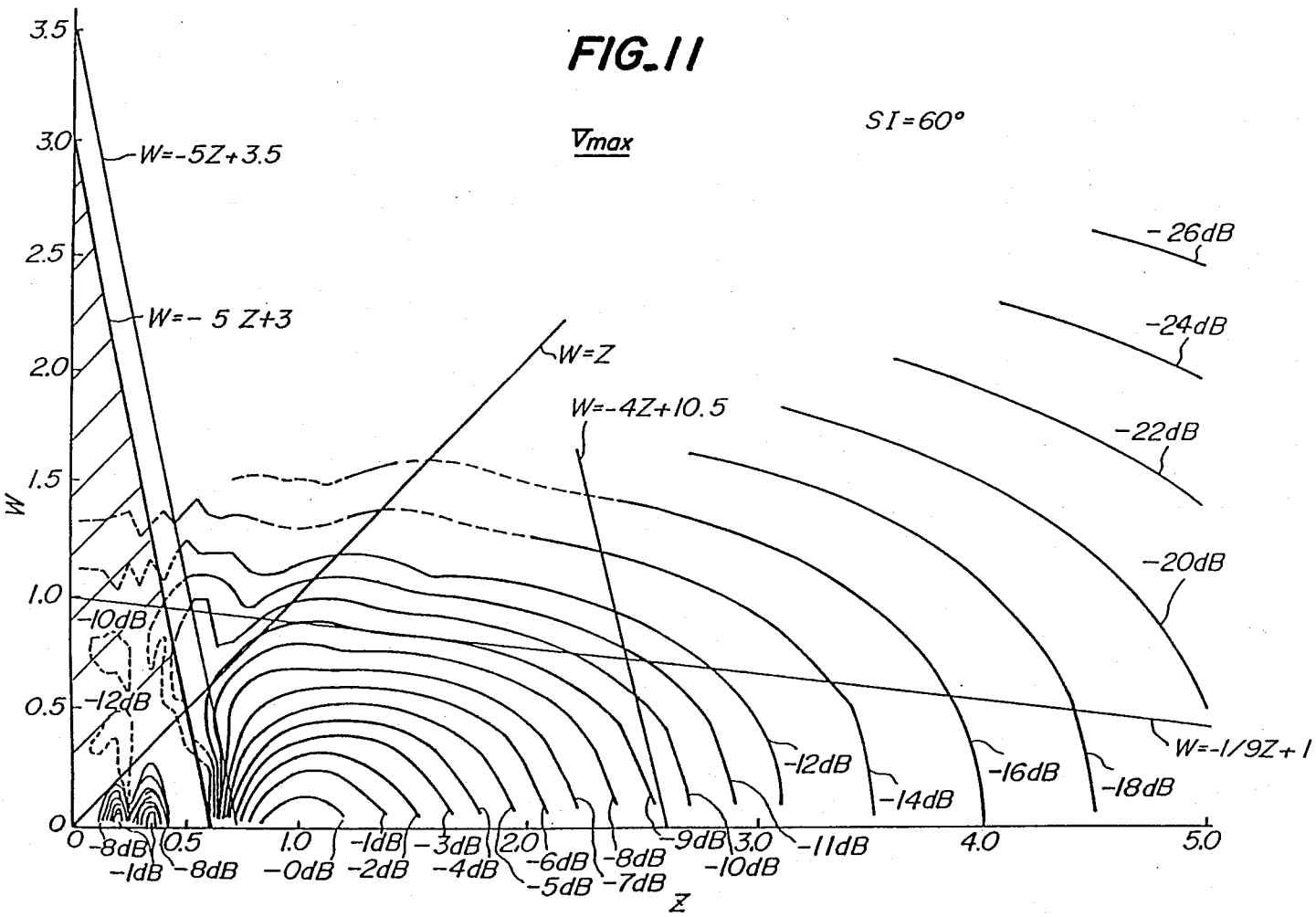
FIGS. 11 and 12 are graphs illustrating the relationships between $V_{max}$ and $V_{max}-V_{min}$ and Z, W of the acoustic lens according to the invention.
Figure 12:
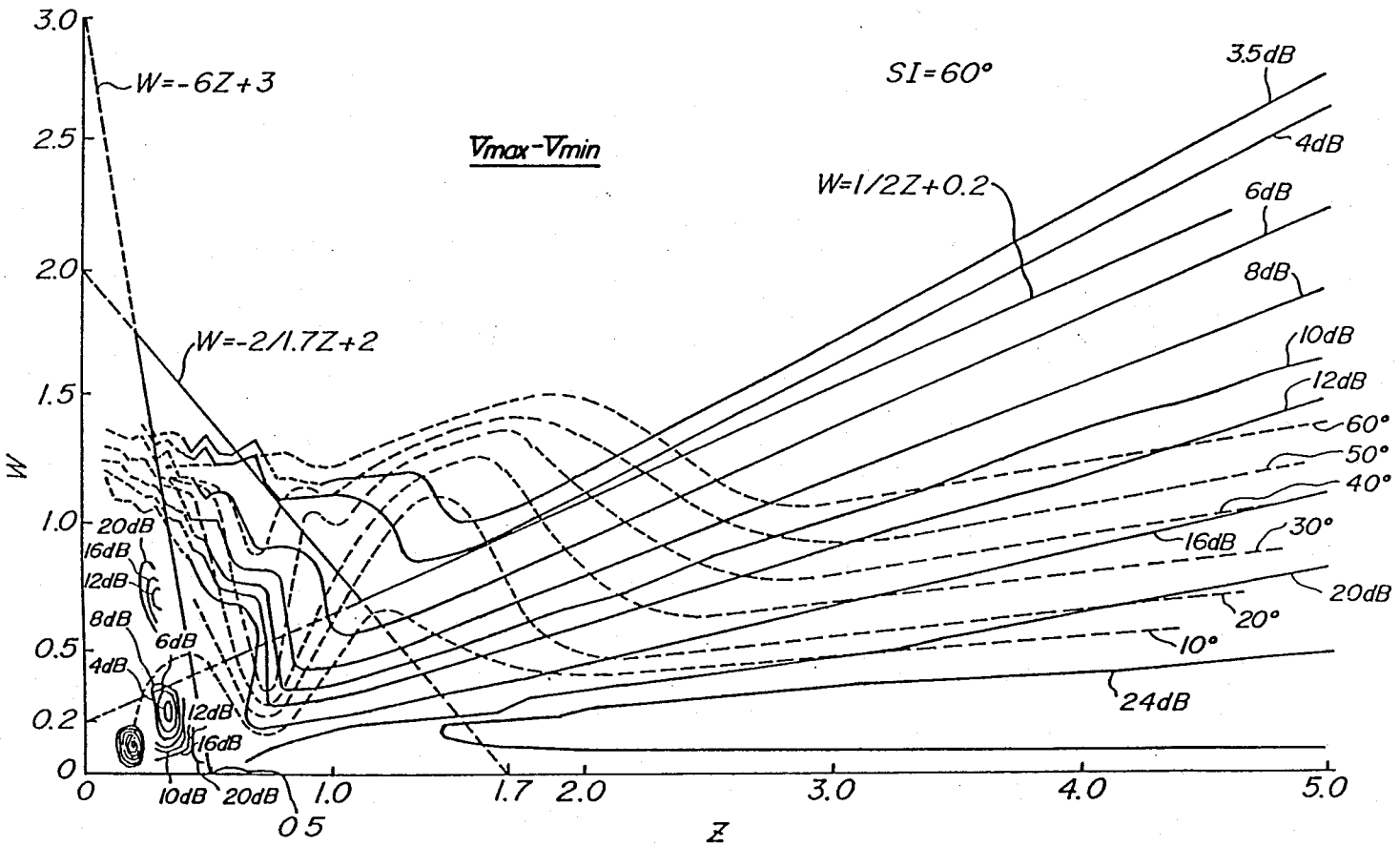

Further, peak value $V_{max}$ of V(Z) for various values of W and Z and difference $V_{max}$-$V_{min}$ between successive peak and valley are calculated and these values are shown in FIGS. 11 and 12, respectively. It has been confirmed that similar curves can be obtained when the aperture angle SI is varied from 45° to 75°. As can be understood from these graphs, superior acoustic lenses can be obtained in a wide region other than the region near $W=1$ and $Z=1$ to which the known acoustic lenses belong. Particularly in a region of $W<1$ and $Z<1$, it is possible to design acoustic lenses having large values of $V_{max}$ and $V_{max}$-$V_{min}$. The graphs further indicate that these are two semi-whirlpool areas about points of $W=0$, $Z=1/5$ and $W=0$, $Z=1/3$. In these areas, if W is changed slightly, the power, i.e. gain is changed largely. This means that in these regions desired characteristics could hardly be obtained owing to manufacturing error. Further, in these graphs regions denoted by broken lines are unstable regions and desired characteristics might not be obtained. The inventors have found that in a region of the graph of $V_{max}$ surrounded by a line $W=Z$, a line $W=-5Z+3$ and the W axis, acoustic lenses having good characteristics could not be obtained. Further, if Z and W are selected from a region surrounded by lines expressed by $W=-1/9Z+1$ and $W=-4Z+10.5$ and the Z axis, it is possible to obtain acoustic lenses having larger powers than those of the known acoustic lenses. Further in the acoustic lens disclosed in the reference (6), two points, $Z=1/3$, $W=1/3$ and $Z=1/5$, $W=1/5$ have been selected. Therefore, regions near these points should be considered to be out of the scope of the invention.

In the graph of $V_{max}$-$V_{min}$, when the phase difference exceeds 50°, $V_{max}$-$V_{min}$ becomes too small and useful V(Z) curves could not be obtained. Therefore, it is preferable to select a phase difference smaller than 50°. In order to design acoustic lenses having larger values of ($V_{max}$-$V_{min}$) then those of the known acoustic lenses, it is preferable to select points (Z,W) from a region surrounded by solid lines expressed by $W=-6Z+3$, $W=-2/1.7Z+2$ and $W=1/2Z+0.2$ and the Z axis. Therefore, if points (Z,W) are selected from a region which is included in both the preferable regions in FIGS. 11 and 12, it is possible to obtain acoustic lenses which are advantageously used for attaining both the amplitude image and V(Z) curve. Such compatible lenses could never be proposed prior to the present invention.

As explained above, according to the invention, values of W and Z are determined by taking into account the acoustic field. Next a process for practically manufacturing the acoustic lens according to the invention will be explained.

Figure 13:
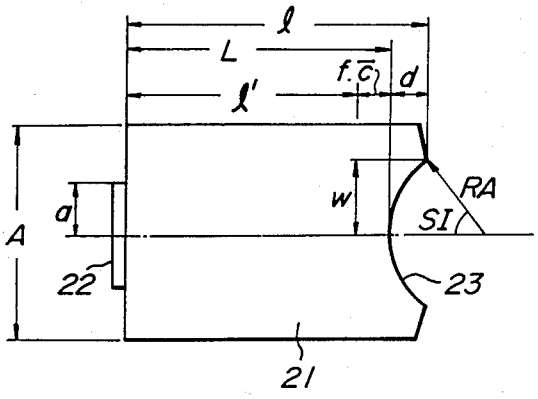
FIG. 13 is a schematic view showing various parameters of the acoustic lens according to the invention.

FIG. 13 is a schematic view showing various parameters of the acoustic lens.

a - - - radius of electric-acoustic piezoelectric transducer 22;

l - - - whole length of acoustic wave propagating solid state medium 21;

d - - - depth of a lens portion 23;

RA - - - radius of curvature of lens portion;

SI - - - aperture angle of lens portion w - - - radius of aperture:

Further, a focal distance is denoted by f and the ratio of the velocity of the acoustic wave in the liquid medium so that in the solid state medium 21 is represented by $\bar{c}$.

Figure 14:
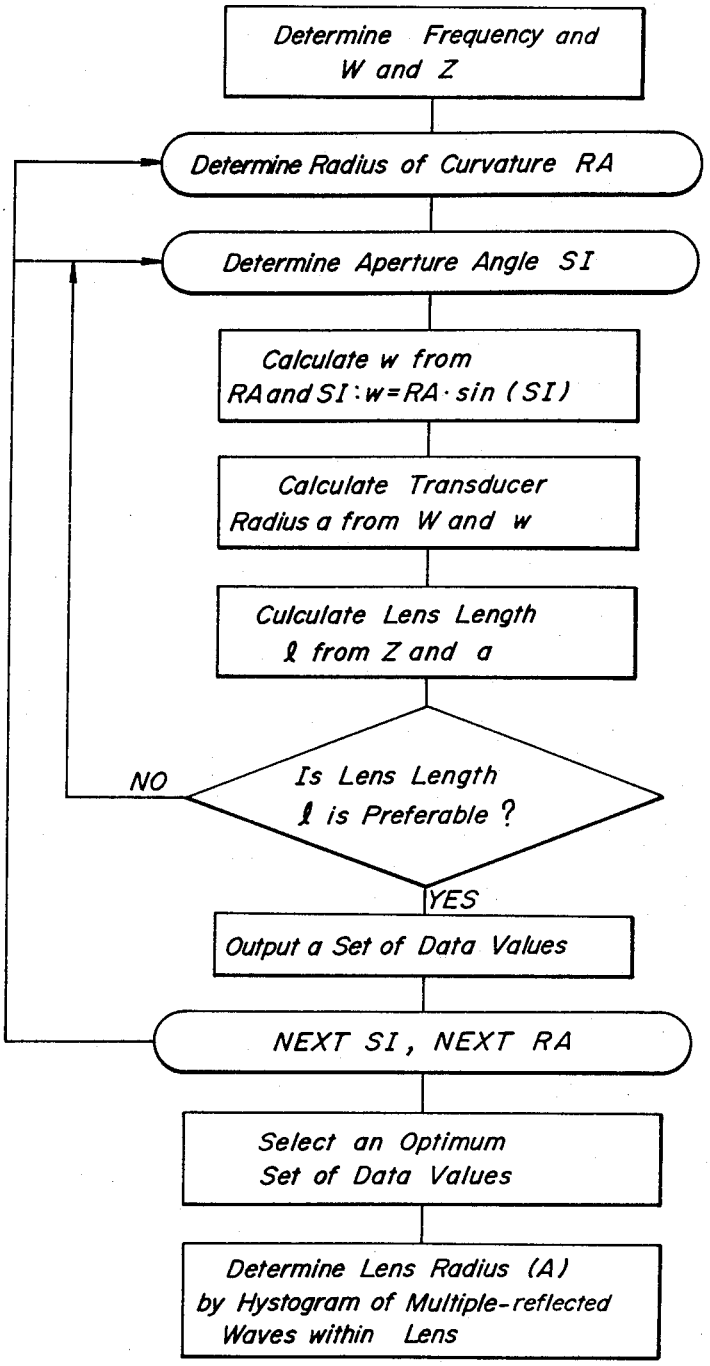
FIG. 14 is a flow chart depicting a process of designing the acoustic lens according to the invention.

FIG. 14 is a flow chart showing the process of manufacturing the acoustic lens according to the invention.

At first, the frequency of the acoustic wave to be used and values of W and Z are determined.

Next, the radius of curvature RA of the lens portion is determined. In this case, the maximum value of RA is determined by loss in the liquid medium. For instance, the radius of curvature RA of the lens portion may be set to 2 mm, 2.5 mm or 3 mm for the acoustic lens of 100 MHz, 0.5 mm, 0.75 mm, 1.00 mm, 1.25 mm or 1.5 mm for 200 MHz, and 0.25 mm or 0.5 mm for 400 MHz.

Then, the aperture angle SI is determined and further the radius of aperture w is calculated from RA and SI in accordance with the equation, $w=RA\cdot\sin(SI)$.

As explained above, since the normalization of $W=w/a$ is effected, the radius a of the transducer is calculated from W and w ($a=w/W$).

Further, by using the equation $Z=l\lambda/a^2$, the length l of the solid state medium is calculated in accordance with the following equation.

$$l=l'+f\cdot c+d$$

Next, it is judged that the acoustic wave reflected from the specimen is made incident upon the transducer without being affected by acoustic waves which have been multiple-reflected within the acoustic lens. That is to say, the acoustic wave reflected from the specimen has to be made incident upon the transducer for time intervals during which the multiply-reflected acoustic waves do not impinge upon the transducer. Conditions for effecting this judgment are determined by considering the minimum pulse repetition time defined by the resolution, timings at which the acoustic wave reflected from the specimen is made incident upon the transducer and timings at which the multiple reflection acoustic wves are made incident upon the transducer. This will be explained in detail hereinbelow.

The theoretical resolution is given by 0.7 λ when the convergence of beam, aberrations, etc. are ignored. Therefore, when a field of view having a width of 2 mm is to be displayed on a television monitor, a number of samplings N of 2000 μm/0.7 λ μm is required. In general, the number of samplings N can be given by $N=L_s/0.7\ \lambda$, wherein $L_s$ is the width of the field of view. Now, it is assumed that the transmitting pulse has a pulse period of $T_s$, then $$T_s=(1/f\times\tfrac{1}{2})\times 0.8(\text{sec})$$

can be obtained. At respective sides of the frame, there are overscan areas of 10%. Then the sampling time $T_1$ is given as follows.

$$T_1=T_s/N(\text{sec})$$

This time should be equal to a time $T_2$ during which the acoustic wave reciprocates between the transducer and the specimen, so that the following equation is established.

$$T_2=2\times\left(\frac{L}{V_s}+\frac{f}{V_w}\right)$$

wherein $V_s$ is the velocity of the acoustic wave in the solid state medium, and $V_w$ is the velocity in the liquid medium situated between the acoustic lens and the specimen. From the above equations, the following equation (12) can be derived:

$$\left.\begin{aligned} L &= \left(T_1 - \frac{f \times 2}{V_w}\right) \times \frac{V_s}{2} \times C \\ &\text{or} \\ L &= \left(\frac{T_s}{N'} - \frac{f \times 2}{V_w}\right) \times \frac{V_s}{2} \\ &\text{wherein } N' = N \times C. \end{aligned}\right\} \quad (12)$$

In the above equation (12) the parameter C is a safety factor which is usually set to 2. The equation (12) starts from the condition that $T_1$ should be equal to $T_2$. Here, $T_1$ is the maximum permissible sampling time, so that the equation (12) gives the maximum lens length L, i.e. the axial length of the acoustic wave propagating solid state medium.

Figure 15:
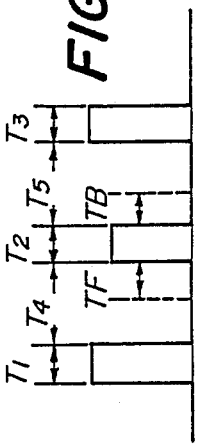
FIG. 15 is a schematic view for explaining the process of determining the lens length by avoiding the influence of multiple reflection within the acoustic lens.

A further condition is that the acoustic wave reflected from the specimen should not be coincident with the multiply -reflected acoustic waves within the acoustic lens. FIG. 15 illustrates a time relation between these acoustic waves. The lens length L should be determined such that the acoustic wave reflected from the specimen is situated between successive acoustic waves multiply-reflected by the acoustic lens. $T_1$, $T_2$ and $T_3$ are determined by the pulse period $T_s$ of the transmitted pulse and $T_s = T_1 = T_2 = T_3$. It is assumed that N waves are inserted in the transmitted signal, and then the following equation can be derived.

$$T_s = \frac{N}{F} \text{ (sec)} \quad (13)$$

In this equation, F is the frequency of the transmitted pulse. The inventors have confirmed from the analysis of the V(Z) curve that necessary marginal distances before and after the transmission are 40 λ and 20 λ, respectively, so that the following equation is established.

$$T_4 = 40\lambda / V_\omega \quad (14)$$

Here, since $\lambda = V_w/F$, the above equation (14) can be rewritten into the following equation (15).

$$T_4 = 40/F \quad (15)$$

Similarly, the following equation (16) is derived.

$$T_5 = 20/F \quad (16)$$

From the above analysis the necessary conditions for obtaining acceptable lens length are expressed as follows:

$$\left.\begin{aligned} TF &> \frac{T_1}{2} + T_4 + \frac{T_2}{2} \\ TB &> \frac{T_1}{2} + T_5 + \frac{T_2}{2} \end{aligned}\right\} \quad (17)$$

When the length l of the acoustic lens is judged to be inadequate, the aperture angle SI is redetermined as depicted in the flow chart shown in FIG. 14. When the lens length is judged to be correct, a first set of data values such as lens radius, aperture angle, lens depth, diameter of transducer and lens length is generated. Then, for the same values of W and Z, a next set of data values is determined in the same manner as that explained above. After a plurality sets of data values have been derived, one can select a suitable set of values. This last selection can be performed by taking into account the phase difference and power of the acoustic field.

Finally, the diameter of the lens is determined by deriving the probability that the transducer receives acoustic waves reflected within the lens by means of ray-tracing acoustic waves emitted from all positions of the transducer. The diameter of lens A is deterined such that said probability is minimized.

Now several examples of data values of the acoustic lenses designed in the manner explained above are shown in the following Table 2.

TABLE 2

| | Phase difference | | | | | |
|---|---|---|---|---|---|---|
| | small | | middle | | large | |
| Frequency | aperture small | aperture large | aperture small | aperture large | aperture small | aperture large |
| 100 MHz | ϕ 10°<br>SI 20°<br>RA 2 | | ϕ 20°<br>SI 20°<br>RA 2.5 | | | |
| 200 MHz | ϕ 5°<br>SI 20°<br>RA 0.75 | | ϕ 20°<br>SI 26°<br>RA 1.25<br>ϕ 5°<br>SI 22°<br>RA 1.5 | | ϕ 30°<br>SI 28°<br>RA 1.25 | |
| 420 MHz | | ϕ 10°<br>SI 60°<br>RA 0.25 | | ϕ 20°<br>SI 56°<br>RA 0.5 | | ϕ 40°<br>SI 62°<br>RA 0.5 |

ϕ: phase difference,
SI: Aperture angle,
RA: radius of curvature (mm)

As explained above in detail, according to the invention, the acoustic lens having desired properties can be designed in an easy and accurate manner. The following Table 3 shows some embodiments of the acoustic lens according to the invention. In these embodiments, the frequency of the acoustic wave was selected to be 400 MHz and the radius of curvature RA is set to 0.5 mm. Further, since the aperture angle SI of the lens portion is usually set to 60° for general specimens, the aperture angle was designed to be about 60°. It should be noted that values of Z and W of examples Nos. 12 and 13 fall within known valves for acoustic lenses.

TABLE 3

| No. | (Z, W) | lens length l (mm) | aperture angle (SI) | radius of transducer a (mm) |
|---|---|---|---|---|
| 1 | 0.8, 0.6 | 15.243 | 60° | 0.722 |
| 2 | 0.8, 0.9 | 6.957 | 60° | 0.481 |
| 3 | 0.8, 1.0 | 5.697 | 60° | 0.433 |
| 4 | 0.9, 0.4 | 29.796 | 50° | 0.958 |
| 5 | 0.9, 0.5 | 20.275 | 52° | 0.788 |
| 6 | 0.9, 0.6 | 17.107 | 60° | 0.722 |
| 7 | 0.9, 0.8 | 9.766 | 60° | 0.541 |
| 8 | 0.9, 1.0 | 6.369 | 60° | 0.433 |
| 9 | 0.9, 1.1 | 5.32 | 60° | 0.394 |
| 10 | 1.0, 0.6 | 18.971 | 60° | 0.722 |
| 11 | 1.0, 0.8 | 10.815 | 60° | 0.541 |
| 12 | 1.0, 1.0 | 7.04 | 60° | 0.433 |
| 13 | 1.0, 1.1 | 5.875 | 60° | 0.394 |
| 14 | 1.2, 0.6 | 22.7 | 60° | 0.722 |
| 15 | 1.2, 0.8 | 12.912 | 60° | 0.541 |
| 16 | 1.2, 1.0 | 8.382 | 60° | 0.433 |
| 17 | 1.2, 1.2 | 5.921 | 60° | 0.361 |
| 18 | 1.5, 0.8 | 16.058 | 60° | 0.541 |
| 19 | 1.5, 1.0 | 10.396 | 60° | 0.433 |
| 20 | 1.6, 0.5 | 41.503 | 58° | 0.848 |
| 21 | 2.0, 0.6 | 37.615 | 60° | 0.722 |
| 22 | 2.0, 1.0 | 13.751 | 60° | 0.433 |
| 23 | 2.0, 1.2 | 9.65 | 60° | 0.361 |
| 24 | 3.0, 0.6 | 49.093 | 54° | 0.674 |
| 25 | 3.0, 0.8 | 31.789 | 60° | 0.541 |
| 26 | 3.0, 1.0 | 20.463 | 60° | 0.433 |
| 27 | 3.0, 1.2 | 14.311 | 60° | 0.361 |
| 28 | 4.0, 0.8 | 42.276 | 60° | 0.541 |
| 29 | 4.0, 1.0 | 27.1744 | 60° | 0.433 |
| 30 | 4.0, 1.2 | 18.971 | 60° | 0.361 |
| 31 | 4.0, 1.4 | 14.025 | 60° | 0.309 |

Frequency: 400 MHz
Radius of curvature RA: 0.5 mm

Figure 16:
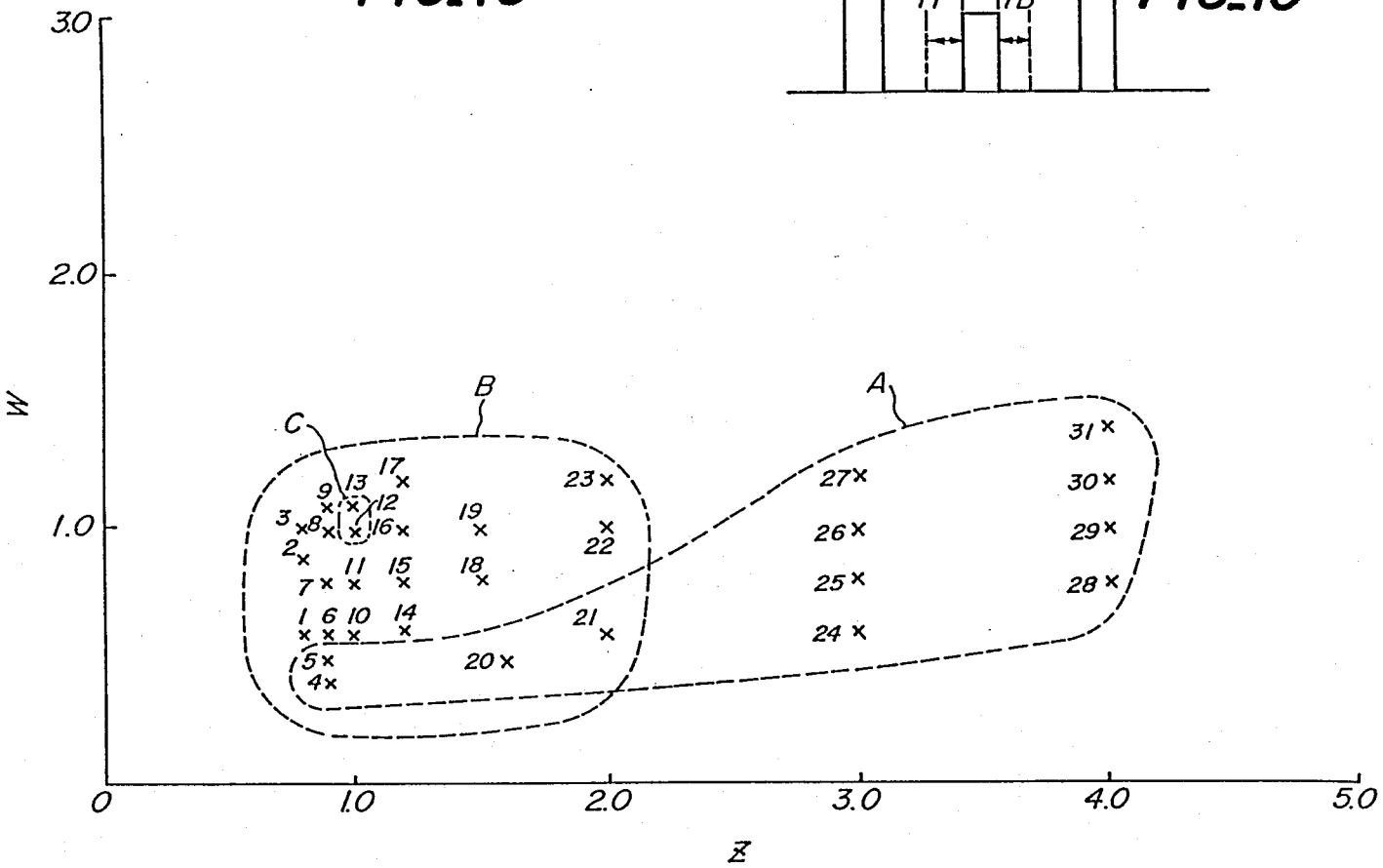
FIG. 16 is a graph in which are plotted values of Z and W of several embodiments of the acoustic lens according to the invention.

FIG. 16 is a graph showing points (Z,W) of the embodiments Nos. 1 to 31 depicted in the Table 3. In all the embodiments, it is possible to obtain large power $V_{max}$ and power difference $V_{max}$-$V_{min}$, so that they can be used as the power lens as well as V(Z) lens. Particularly, the group surrounded by broken circle A is preferable as the V(Z) lens and the group surrounded by broken circle B is preferable as the amplitude contrast lens. Therefore, the embodiments belonging to both groups A and B can be preferably used as both the V(Z) lens and the amplitude contrast lens. In FIG. 16 the region near the point (Z,W)=(1,1) belonging to the known acoustic lens is shown by broken line C.

In the above embodiments, the frequency of the acoustic wave was 400 MHz. According to the invention it is possible to design various acoustic lenses to be used at any desired frequencies. For instance, an acoustic lens for a low frequency such as 50 MHz having the following data values is obtained.

Z=0.8
W=0.9
radius of transducer a=4.811 mm
lens length l=86.14 mm
radius of curvature RA=5.0 mm
aperture angle SI=60° When such a low frequency acoustic lens is used, the acoustic wave can penetrate into a specimen to a depth of about 3 mm, so that it can be advantageously used to detect defects in a bond in a semiconductor chip or internal defects of ceramic products.

As explained above, according to the invention it is possible to obtain new acoustic lenses having various properties by designing on the bases of values of Z and W which are selected from the region outside the region near the point (Z,W)=(1,1) of the known acoustic lens. Therefore, optimum acoustic lenses for various applications can be easily and accurately selected. Further, it has been confirmed that the acoustic lens for obtaining the V(Z) curve may have a phase difference of up to 50°, and thus a V(Z) acoustic lens having a higher power can be obtained.

What is claimed is:

1. An acoustic lens for use in an acoustic microscope, comprising:

a solid state medium for prepagating an acoustic wave having a wavelength λ, said solid state medium including opposed end surfaces separated from each other by a length l;

an electric-acoustic piezoelectric transducer applied on one end surface of said solid state medium and having a radius a; and a lens portion formed in the other end surface of said solid state medium in coaxial arrangement with said transducer and having an aperture radius w;

whereby the dimensions of said acoustic lens are further defined by a ratio $l\lambda/a^2$, represented by a variable Z, and a ratio w/a, represented by a variable W, wherein Z is equal to a positive value less than 1 and W is equal to a positive value other than 1, and Z and W are not contemporaneously equal to 1/5 or ⅓, such that an acoustic field having desired power and/or phase can be obtained in the solid-state medium.

2. An acoustic lens according to claim 1, wherein said lens portion is spherical.

3. An acoustic lens according to claim 1, wherein a phase difference of an acoustical field at the lens portion does not exceed 50°.

4. An acoustic lens for use in an acoustic microscope, comprising:

a solid state medium for propagating an acoustic wave having a wavelength λ, said solid state medium including opposed end surfaces separated from each other by a length l;

an electric-acoustic piezoelectric transducer applied on one end surface of said solid state medium and having a radius a; and a lens portion formed in the other end surface of said solid state medium in coaxial arrangement with said transducer and having an aperture radius w;

whereby the dimensions of said acoustic lens are further defined by a ratio $l\lambda/a^2$, represented by a variable Z, and a ratio w/a, represented by a variable W, wherein $W<Z$, $W\geqq -5Z+3$, and Z and W are positive values other than 1, such that an acoustic field having desired power and/or phase can be obtained in the solid state medium.

5. An acoustic lens for use in an acoustic microscope, comprising:

a solid state medium for propagating an acoustic wave having a wavelength λ, said solid state medium including opposed end surfaces separated from each other by a length l;

an electric-acoustic piezoelectric transducer applied on one end surface of said solid state medium and having a radius a; and a lens portion formed in the other end surface of said solid state medium in coaxial arrangement with said transducer and having an aperture radius w;

whereby the dimensions of said acoustic lens are further defined by a ratio $l\lambda/a^2$, represented by a variable Z, and a ratio w/a, represented by a variable W, wherein $W<Z$, $W\leqq -5Z+3.5$, $W\leqq -1/9Z+1$, $W\leqq -4Z+10.5$, and Z and W are positive values other than 1, suchthat an acoustic field having desired power and/or phase can be obtained in the solid state medium.

6. An acoustic lens for use in an acoustic microscope, comprising:

a solid state medium for propagating an acoustic wave having a wavelength λ, said solid state medium including opposed end surfaces separated from each other by a length l;

an electric-acoustic piezoelectric transducer applied on one end surface of said solid state medium and having a radius a; and a lens portion formed in the other end surface of said solid state medium in coaxial arrangement with said transducer and having an aperture radius w;

whereby the dimensions of said acoustic lens are further defined by a ratio $l\lambda/a^2$, represented by a variable Z, and a ratio w/a, represented by a variable W, wherein $W\geqq -6Z+3$, $W\leqq -2/1.7Z+2$, $W\geqq \frac{1}{2}Z+0.2$, and Z and W are positive values other than 1, such that an acoustic field having desired power and/or phase can be obtained in the solid state medium.

7. An acoustic lens according to claim 6, wherein $W<Z$, $W\geqq 5Z+3.5$, $W\leqq -1/9Z+1$, and $W\leqq -4Z+10.5$.

* * * * *